United States Patent [19]

Trezza

[11] Patent Number: 4,641,473

[45] Date of Patent: Feb. 10, 1987

[54] CLIP CONSTRUCTION FOR WALL ARRANGEMENT

[76] Inventor: Ronald F. Trezza, P.O. Box 764, Melville, N.Y. 11747

[21] Appl. No.: 812,233

[22] Filed: Dec. 23, 1985

[51] Int. Cl.[4] ..... E04B 5/00

[52] U.S. Cl. ..... 52/410; 52/487; 52/714

[58] Field of Search ..... 52/410, 714, 715, 357, 52/483, 539, 593, 487

[56] References Cited

U.S. PATENT DOCUMENTS

| | | | |
|---|---|---|---|
| 814,134 | 3/1906 | Hood | 52/714 |
| 1,076,836 | 10/1913 | Merwin | 52/714 |
| 2,021,922 | 11/1935 | Peck | 52/593 |
| 2,213,355 | 9/1940 | Woodworth | 52/715 |
| 2,791,117 | 5/1957 | Bailey | 52/410 |
| 2,919,572 | 1/1960 | Salzi | 52/410 |

FOREIGN PATENT DOCUMENTS

| | | | |
|---|---|---|---|
| 654411 | 12/1937 | Fed. Rep. of Germany | 52/714 |
| 816889 | 8/1951 | Fed. Rep. of Germany | 52/410 |
| 176249 | 3/1922 | United Kingdom | 52/715 |
| 928800 | 6/1963 | United Kingdom | 52/410 |

*Primary Examiner*—Henry E. Raduazo

*Attorney, Agent, or Firm*—Roberts, Spiecens & Cohen

[57] ABSTRACT

A clip construction is provided for a wall construction in which siding sections on a wall are arranged in coplanar end-to-end relationship. The clip fits between the facing ends of the siding sections and includes a shaped central portion positioned between the siding sections and further portions extending in opposite directions from the central portion along the siding sections. From one of the further portions of the clip extends a flange into which are embodied parallel ridges which are shaped so as to have profiles generally in the form of arrowheads. These ridges are embedded in a settable material such as mortar which intervenes between bricks which cover the siding sections.

4 Claims, 3 Drawing Figures

CLIP CONSTRUCTION FOR WALL ARRANGEMENT

FIELD OF THE INVENTION

This invention relates to clip constructions and more particularly to clips which are suitable for engaging wall sections and for providing an anchorage for settable materials which are employed to cover such walls.

BACKGROUND

A large number of U.S. Patents have been located which reveal different types of clip constructions adapted for use with endwise abutting wall sections or the like. These patents include U.S. Pat. Nos. 1,662,177; 1,791,639; 1,939,528; 2,648,103; 3,102,366; 3,134,197; 3,608,2631 3,675,383; 3,782,058, 4,069,636 and 4,156,993.

In U.S. Pat. No. 3,782,058, G. E. Allen discloses a tying device for tying a wooden board to the uppermost tier of face bricks and a composite face brick and concrete block wall construction. The tying device described therein is formed by stamping from a thin sheet of flat metal stock. It is designed to be installed laterally between the inside faces and the outside faces of masonry blocks and to lie between the butt joints of the concrete. The tying device of this patent includes an elongated body member having opposite flat faces and an upper end and a lower end. The lower end is bent laterally outwardly to define a horizontal anchoring foot integral with the body member. The upper end of the body member is split longitudinally and defines a pair of oppositely horizontally extending tying arms extending from the upper end of the body member perpendicularly in opposite directions therefrom. As will be seen hereinafter, such structure differs in material respects from the structure provided in accordance with the instant invention.

In U.S. Pat. No. 3,134,197, M. McColley discloses an elongated spacer member having a rear upright flange portion secured to a structure by which a panel is supported and which underlies the rear face of the panel along the bottom marginal edge portion thereof, the bottom of the flange being substantially at the level of the bottom edge of the panel. There is furthermore provided a ledge portion integral with the upright flange portion and projecting forwardly from the bottom thereof, the ledge portion closely underlying the bottom edge of the panel to support the same. Moreover, there is provided a front upright portion integral with the ledge portion and projecting downwardly from the front thereof to the rim of the associated fixture, the front face of the front upright portion being coplanar with the front face of the panel. In addition, there is provided an integral lip portion projecting obliquely rearwardly and upwardly from the bottom of the front upright portion. As will be seen hereinafter, this structure differs in substantial respects from the structure of the present invention.

In U.S. Pat. No. 2,648,103, O. Wahlfeld discloses a wall covering for attachment to the sheathing of a wall structure comprising siding pieces arranged for securement to the sheathing and a molding to support in space each successive siding piece in a given relationship with respect to the adjacent attached piece. The molding comprises a stepped section to engage over the attached siding piece with a surface portion thereof in coplanar contact with the face of the siding piece, a support section for connection with the next successive siding piece, and deformations in the surface portion of the stepped section of the molding for holding the molding in place upon the attached siding piece with a nailing of the molding to the sheathing.

R. Slowinski shows in U.S. Pat. No. 3,102,366 an end joint clip for spanning and supporting the abutting ends of contiguous wall panels on spaced wall panels spanning each end of the joint between said abutting ends to prevent misalignment and sagging of the abutting ends. The clip is adapted to be installed after erection of the contiguous and spaced panels and is of a construction comprising an elongated and substantially flat rib, bowed along its longer axis into a single substantially convex-concave arch. Furthermore, a substantially flat arm is provided which projects laterally outwardly from the convex side of the rib adjacent to each end thereof and which is arranged transversely of the longer axis. A tab is furthermore provided projecting laterally outwardly from the side of each arm remote from the other arm and diverging from the tab on the other arm towards the concave side of the rib and being arranged transversely of the longer axis.

The aforesaid structures, as well as the structures of the other above-noted patents, differ substantially from the construction of the present invention as described in detail hereinbelow.

SUMMARY OF INVENTION

It is an object of the invention to provide an improved clip construction suitable for use with endwise abutting wall sections.

It is another object of the invention to provide an improved clip construction adapted for providing an anchorage for mortar and the like.

It is yet another object of the invention to provide an improved clip construction which is readily manufactured with mass production techniques.

Still another object of the invention is to provide an improved clip construction suitable for accommodating tongue and groove elements which are embodied into abutting wall sections.

To achieve the above and other objects of the invention, there is provided a clip construction which, as will be described in greater detail hereinbelow, embody a central portion adapted to lie between abutting siding sections, further portions extending angularly from the central portion at spaced positions on the central portion and being adapted to lie on opposite sides of the associated siding, and protruding or anchorage means on at least one of the aforesaid further portions and adapted for being embedded in a body of material which is applied between bricks on the siding.

More particularly, the said further portions mentioned above are at least generally parallel to one another and extend at least generally orthogonally in opposite directions from the central portion. Moreover, as will be shown in detail, the central portion includes groove means defining a groove extending generally in parallel with the aforesaid further portions. This groove is preferably of tapered edge and may be more specifically of a trapezoidal profile.

The protruding means mentioned above serves as an anchorage and in accordance with a preferred embodiment of the invention, as will be described in detail hereinbelow, includes at least one ridge with the general shape of an arrowhead pointing away from the associated further portion. More particularly the protruding means may include a flange on and extending from the associated further portion and a ridge extending along the flange and spaced from and at least generally parallel to the associated further portion. The ridge may have a sawtooth-shaped profile and protrude from opposite sides of the flange thereby to provide the arrowhead shape referred to hereinabove. Thus, there may be provided, for example, two parallel ridges having profiles which are arrowhead-shaped and which point in a direction away from the associated further portion.

As a specific feature of the invention, the ridges each may have preferably a dimension extending in the aforementioned direction and a mutual spacing therebetween. The above-mentioned dimension and spacing are preferably substantially equal to one another and to the thickness of the flange. Thus, in a preferred embodiment the flange may have a dimension of 0.050 to 0.100 inches (preferably around 0.062 inches). The ridges may preferably extend about 0.02–0.05 inches to opposite sides of the flange.

The above and other objects, features and advantages of the invention will be found in the detailed description which follows hereinbelow as illustrated in the accompanying drawing.

DETAILED DESCRIPTION OF THE DRAWING

Figure 1:
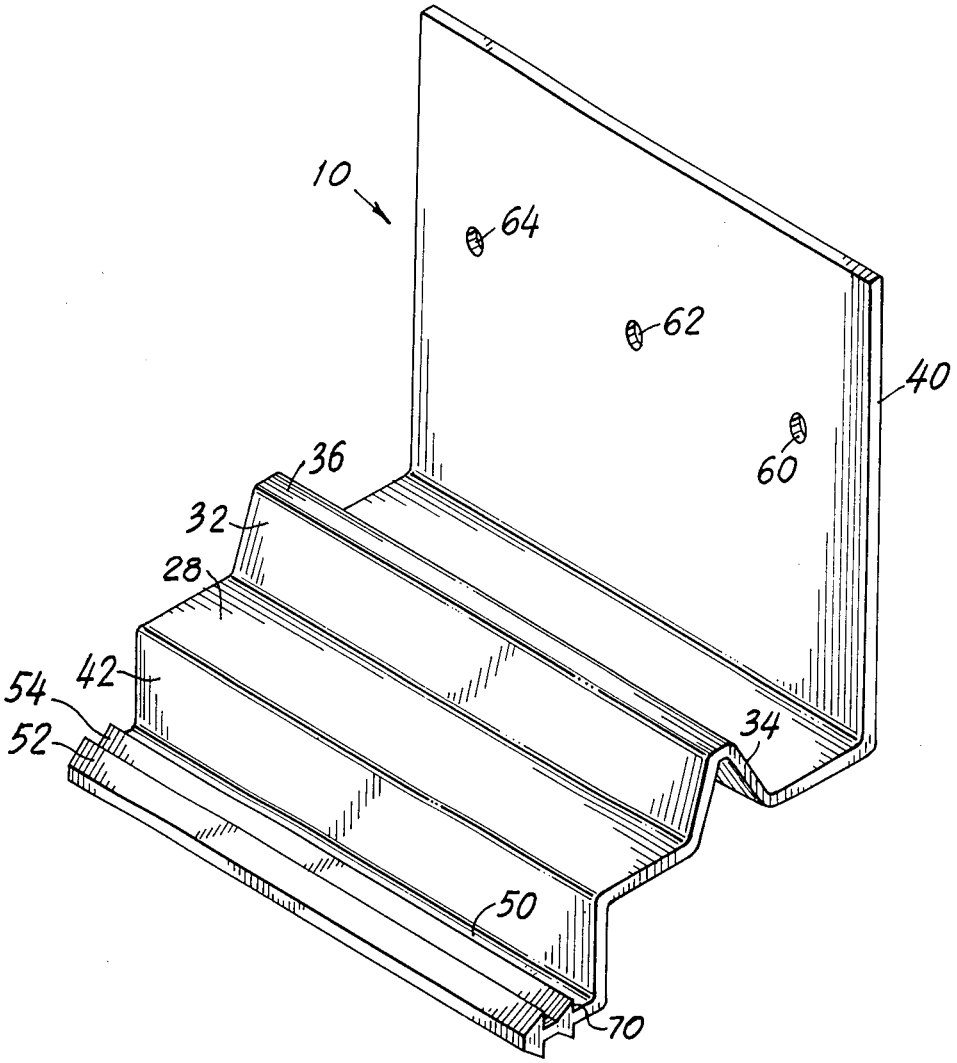
FIG. 1 is a perspective view of a clip construction provided in accordance with the invention.
Figure 2:
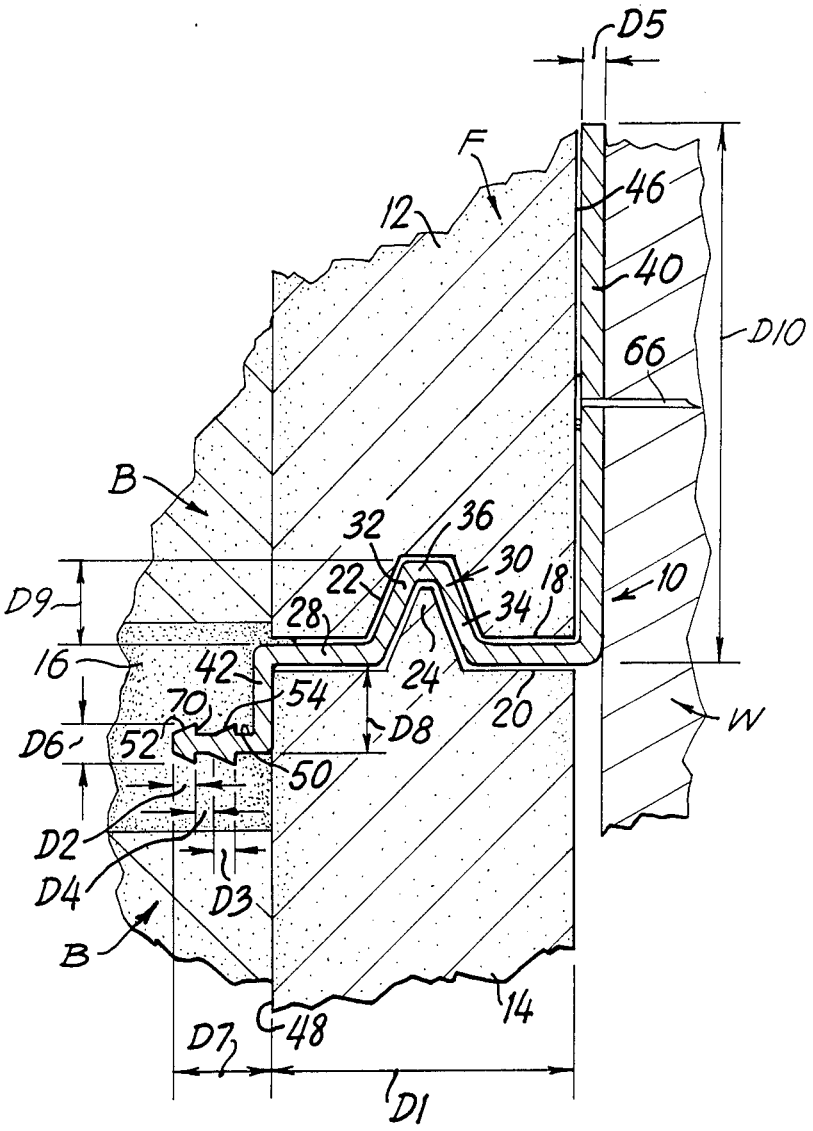
FIG. 2 is a side view of the clip construction of FIG. 1, the view further showing abutting siding sections to which has been applied bricks with intervening settable material.
Figure 3:
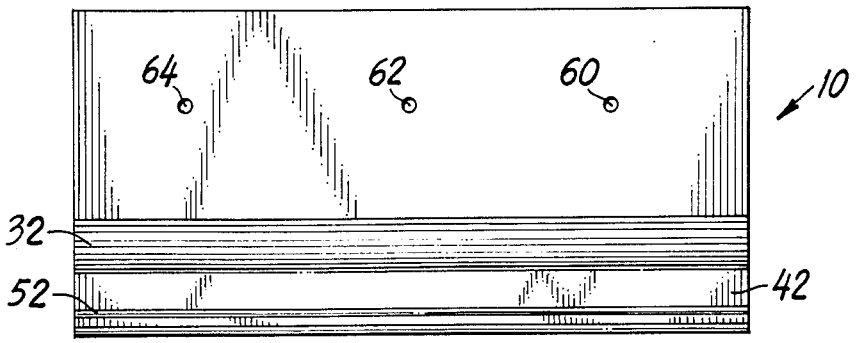
FIG. 3 is a front view of the clip construction of FIGS. 1 and 2.

In the drawing the clip construction of the invention is indicated at 10. It is embodied in a wall construction which is more readily apparent from the side view which is shown, partially in section, in FIG. 2. Therein are illustrated foam siding sections 12 and 14 to which has been applied bricks B with intervening settable material such as mortar which is indicated by way of example at 16.

The siding sections 12 and 14 have ends 18 and 20 which are in facing and abutting relationship except for the intervention of clip 10 (some spacing is shown between ends 18 and 20 and clip 10 for illustrative purposes). The end 18 of siding section 12 is provided with a groove 22. The end 20 of siding section 14 is provided with a tongue or projection 24. Groove 22 and tongue 24 constitute a cooperating tongue and groove arrangement which together prevent a lateral displacement of sections 12 and 14 relative to one another. This arrangement is well-known and does not require further explanation in this text.

The clip construction 10 includes a central portion 28 which includes a groove defining portion 30. The groove defining portion 30 consists of side members 32 and 34 connected by a horizontal top section 36. The parts 32, 34 and 36 cooperatively constitute a tapered member having the cross-section of a truncated pyramid or of a trapezoid.

Connected at spaced positions on the central portion 28 are further portions 40 and 42. Preferably, portions 40 and 42 are at least substantially perpendicular or othogonal relative to central portion 28. Also portions 40 and 42 are preferably parallel to one another. In the preferred embodiment of the invention, portions 40 and 42 extend in opposite directions from each other and from the central portion 28.

The portions 40 and 42 are spaced from each other by a distance Dl which may be in the order of magnitude of about one inch and which is such that they effectively straddle the siding constituted by sections 12 and 14 with the provision that the further portion 40 extends along the face 46 of siding section 12 and the further portion 42 extends albng the face 48 of the section 14. Thus, together with the trapezoidally-shaped groove defining section 30 and the further portions 40 and 42 of the clip construction 10 there is provided a means for rigorously confining the relative movement between the sections 12 and 14 especially with respect to lateral displacement as a consequence whereof a rigid and well-defined structure is enabled.

The further portion 42 of clip construction 10 is additionally provided with a flange 50. On this flange are located irregularities, protrusions or projections indicated generally at 52 and 54. These protrusions serve as anchorages for the material 16 which is preferably a settable material such as mortar and which is applied in viscous form and which solidifies into a solid body in which the ridges 52 and 54 are embedded. Upon a setting of the material 16, the ridges 52 and 54 constitute an anchorage holding the mortar to the wall W on which are mounted sections 12 and 14 and other such siding sections as may be provided.

The ridges 52 and 54 each protrude in opposite directions from the flange 50 and are ridges of solid form which are parallel to the further portion 42 as well as to further portion 40. These ridges have a maximum dimension along the extent of the flange indicated at D2 and D3. Moreover, the ridges are spaced apart by a distance indicated at D4. Preferably the dimensions D2, D3 and D4 are equal to one another and are equal to the thickness of the material from which the clip construction is made, which thickness is indicated at D5. This common dimension is preferably in the order of magnitude of from 0.050–0.100 inches. The ridges preferably extend to about 0.02–0.05 inches to opposite sides of the flange. A total dimension is indicated by way of example at D6 in a preferred embodiment of the invention. This dimension may vary, for example, from 0.100–0.125 inches. Other dimensions D7 and D8 are, for example, 0.313 and 0.218 inches. In addition, examples of dimensions D9 and D10 may be for example 0.313 and 1.750 inches.

The clip construction comprising central portion 28 from which extend further portions 40 and 42 and inclusive of flange 50 and the ridges thereon is preferably formed as a monolithic structure manufactured, for example, of a metal such as steel or aluminum. The clip construction may furthermore be constructed of other material such as, for example, plastic, wood, hard rubber or the like.

The clip construction of the invention is provided in at least further portion 40 with a series of nail holes as indicated by way of example at 60, 62 and 64. These nails facilitate the application of fastening members such as indicated at 66 in the form of one or more nails which may be employed to fasten the clip construction in place relative to the associated wall W and which function to prevent withdrawal of the siding sections from the clip construction and from other adjacent siding sections.

As can be seen from the drawing and from the above description, the arrowheads constituting the two parallel ridges on the flange 50 point away from the further portion 42 of the clip. Thereby, the function whereby the ridges serve as anchorages is enhanced especially by reason of the flat faces such as indicated at 70 which are parallel portion 42 and serve to prevent withdrawal of the mortar material 16, thereby firmly securing the mortar 16 to the wall W and to siding sections 12 and 14 and the like.

From what has been stated above, it will follow that there is also provided a wall construction which comprises a wall including siding sections in coplanar end-to-end relationship and including cooperative tongue and groove means to resist relative transverse movement between the sections. The wall construction will include the aforesaid clip which itself includes a central portion between the siding sections which central portion includes a part configured to the tongue and groove means to accommodate the same. The clip construction moreover includes first and second further portions extending from the central portion along the siding on opposite sides of the same. Protruding means extend outwardly from the first further portion and includes a flange upon which are embodied ridges in the shape of arrowheads whereby to be embodied in and serve as an anchorage for settable material which is applied between bricks B which are bonded to the siding sections by an adhesive. It will be noted that the clip is below and carries the weight of siding section.

There will now be obvious to those skilled in the art many modifications and variations of the clip and wall construction set forth hereinabove. These modifications and variations will not depart from the scope of the invention if defined by the following claims:

What is claimed is:

1. A clip construction adapted for retaining a body of material against a wall which includes siding sections in generally endwise abutting relation, said clip construction comprising a central portion adapted to lie between said siding sections, parallel further portions extending perpendicularly from the central portion at spaced positions on the central portion and being adapted to lie on opposite sides of said siding sections, and protruding means on at least one of said further portions and adapted for being embedded in said body to retain said body against said wall, the other of said further sections being adapted for connection to the wall, said central portion including groove means defining a trapezoidal groove extending generally in parallel with said further portions, said protruding means including a flange on and extending from said one further portion and parallel ridges extending along and on opposite sides of said flange and being spaced from and at least generally parallel to said one further portion, said ridges having profiles which are arrowhead-shaped and which point in a direction away from said one further portion, said ridges being solid and having faces which are parallel to said one further portion.

2. A clip construction as claimed in claim 1 wherein said ridges each have a dimension extending in said direction and a mutual spacing from each other, said dimension and spacing being substantially equal to each other and to the thickness of the flange.

3. A clip construction as claimed in claim 2 wherein the flange is about 0.050–0.100 inches and said ridges extend about 0.2–0.05 inches to opposite sides of the flange.

4. A wall construction comprising a wall, siding sections on said wall and in coplanar end-to-end relationship and including cooperative tongue and groove means to resist relative transverse movement between said sections, a clip including a central portion between said sections and including a part configured to said tongue and groove means to accommodate the same, said clip including first and second further portions extending from said central portion along said wall and on opposite sides of the siding sections, protruding means extending outwardly from the first further portion, and a settable material adjacent the wall and in which said protruding means is embedded, said protruding means including a flange on and extending from said first further portion and parallel ridges extending along and on opposite sides of said flange and being spaced from and at least generally parallel to said first further portion, said ridges having profiles which are arrowhead-shaped and which point in a direction away from said one further portion, said ridges further being spaced and each having a maximum dimension extending in said direction and a maximum dimension transverse to said flange, said dimensions being substantially equal to each other, to the spacing between the ridges and to the thickness of the flange, said ridges having a face parallel to said one further portion.

* * * * *